United States Patent [19]

Ulsteen

[11] 4,376,083

[45] Mar. 8, 1983

[54] PROCESS FOR THE PREPARATION OF ALUMINUM-CONTAINING HIGH-ENERGY EXPLOSIVE COMPOSITIONS

[75] Inventor: Kare Ulsteen, Saetre i Hurum, Norway

[73] Assignee: Dyno Industrier A.S., Oslo, Norway

[21] Appl. No.: 228,056

[22] Filed: Jan. 26, 1981

[30] Foreign Application Priority Data

Feb. 29, 1980 [NO] Norway ..... 800582

[51] Int. Cl.[3] ..... C06B 21/00

[52] U.S. Cl. ..... 264/3 D; 149/6; 149/11; 149/19.92; 149/19.93; 149/92; 149/105; 149/108.2; 264/3 C

[58] Field of Search ..... 149/6, 11, 19.92, 19.93, 149/92, 105, 108.2; 264/3 C, 3 D, 3 E

[56] References Cited

U.S. PATENT DOCUMENTS

| | | | |
|---|---|---|---|
| 2,982,641 | 5/1961 | Dawson et al. | 149/105 X |
| 3,706,609 | 12/1972 | Voigt et al. | 149/105 X |
| 4,089,715 | 5/1978 | Scherzinger | 149/108.2 |
| 4,100,000 | 7/1978 | Sterling et al. | 264/3 C |

FOREIGN PATENT DOCUMENTS

| | | | |
|---|---|---|---|
| 1183916 | 3/1970 | United Kingdom | 149/105 |

*Primary Examiner*—Leland A. Sebastian
*Attorney, Agent, or Firm*—Ladas & Parry

[57] ABSTRACT

A castable high-energy explosive composition comprising trinitrotoluene (TNT) and crystalline explosives of the RDX or HMX type as well as aluminum powder, and, optionally, flegmatizing agents and stablizers consisting of wax, lecithin and nitrocellulose (NC), is prepared by dispersing crystals of RDX (or HMX) in water with wax, under heavy stirring and a temperature above the melting point of the wax, then adding aluminum powder, treated in order to tolerate water, to the dispersion, and then, optionally, cooling in order to separate the explosive as granules. A further step comprises melting and dispersing TNT in hot water under heavy stirring, optionally under the addition of wetted NC and lecithin, then reducing the temperature to below 80° C., and separating the solidifying, dispersed explosive droplets in the form of granules. The final step comprises mixing the products from the former steps in specific ratios so as to provide the final explosive compositions known by the name "Hexotonal" or "Octonal", respectively. Alternatively, the mixtures of granules from the first two steps are melted together and cast on a drum, ribbon or plate, or the first two are combined in the same reactor before any part of the dispersed phases has solidified.

15 Claims, No Drawings

PROCESS FOR THE PREPARATION OF ALUMINUM-CONTAINING HIGH-ENERGY EXPLOSIVE COMPOSITIONS

High-energy explosive compositions which can be formed by casting are well known in the prior art. They contain at least one explosive component having a suitable melting point, which enables it, without any significant risk, to be kept liquid during the casting operation, at the same time serving as a matrix for the solid explosive components in crystalline or powdered form.

Trinitrotoluene (TNT), having a melting point of about 80° C., is in wide use for the above purpose. However, according to modern, technical thoughts, TNT possesses relatively restricted explosive properties and, thus, substantial additions of stronger, solid, cystalline high-energy explosives are preferred for more exigent purposes.

Thus, explosive compositions derived from Hexogen (RDX) or Octogen (HMX) embedded in TNT, are in extensive use. These compounds are particularly usable when a high brisance is required, i.e. high detonation velocity, which is a proviso for a good cutting effect. This is of great importance, such as in the demolition of steel structures, pipelines, and for military use, such as in armour-penetrating arms. Such explosives are for instance termed Hexotol, Cyclotol, Composition B ("Comp.B") and Octol.

An additional class of high-energy explosives having modified explosive properties, for instance high blasting effect especially below water, may be obtained by adding aluminum powder to the above mentioned explosive compositions of the Hexotol and Octol type, respectively. Said class is in the U.S. termed "Aluminized explosives" whereas in Europe it has the generic name "Hexotonal" or "Octonal", respectively, depending on whether the origin is hexogen or octogen. More specifically, representatives of said class are known by such names as Torpex, H-6, HBX-1, HBX-3, Hexotonal, SSM 8870, and HTA-3, the last mentioned being based on HMX. Said grades are in particular used for military purposes, such as the filling of shells, missiles and rockets, as well as mines, depth bombs, torpedoes etc.

The aluminum content of said grades varies between 15 and 35 percent by weight.

It is important to the use that melting and cast filling of said articles do not involve excessive sedimentation of the solid particles. Thus, it is usual to add certain means to counteract such a tendency. A particular product in general use in the above mentioned hexotonal compositions, also having a for safety reasons favourable effect as a "phlegmatisate", is known by the name "Composition D-2" also called "Comp. D-2" or, short, just "D-2". The latter product has the following composition: Wax 84, NC 14, Lecithin 2, all expressed as percent by weight.

A general method for the preparation of aluminum-containing high-energy explosives, e.g. Hexotonal, mainly performed by the person who takes care of the loading of ammunition, is in short as follows:

In a melting kettle, provided with mechanical stirring equipment, RDX and TNT are charged in the form of Hexotol, possibly under additional charging of TNT.

The above way of charging is due to the fact that sensitive crystalline high-energy explosives such as RDX or HMX, cannot be transported or handled in their dry state without being phlegmatised with a component which, preferably, shall constitute a part of the final composition. Such a phlegmatisation is, i.a., present in the usual commercial grade, e.g. "Comp.B" wherein the mixing ratio RDX/TNT is 60/40. In such case, additional TNT must be charged in the melting kettle.

To the above is added a phlegmatising agent, preferably in the form of "Comp. D-2".

Finally, aluminum powder is added to the melt, the temperature and stirring conditions being maintained as prescribed for the casting operation.

Aluminum powder is charged to the kettle in dry form. Such an operation is not desirable for the following reasons:

The tendency to dust formation can hardly be suppressed completely, and this destroys the environment, annoys the operator and makes the charging difficult.

Primarily, aluminum dust in the air may imply a significant dust explosion hazard which might have catastrophic consequences.

Secondarily, aluminum dust in the production premises will deposit on horizontal surfaces, and due to subsequent turbulences in the air, may give rise to dust explosions, if not removed in time.

Aluminum powder which has not been stabilized against moisture, must be protected against contact with water, also against moisture in the air, in order to avoid explosive hydrogen formation during the reaction of aluminum with water. Thus, dry production premises are required.

From the above, which is regarded common knowledge, it may appear that the prior art with respect to the mentioned grades of castable explosives, is encumbered with the following aspects:

1. The handling of free aluminum powder is hazardous and demands specific requirements of the production premises, equipment, cleaning processes, and also, the personnel.

2. The charging of a plurality of components is required, from which follows a reduced possibility of control prior to the casting operation.

3. A limited availability of "Composition D-2".

The purpose of the present invention is to provide a process for the preparation of the mentioned aluminum-containing explosive compositions in order to remove, or at least minimize, the adverse aspects which the consumer has to face in the melt loading of ammunition.

First, the purpose of the invention is to remove completely the need of handling free aluminum from the working area of the consumer.

Second, the purpose of the invention is to reduce the number of components to a minimum, in fact to one or two, from which follows an improved possibility of analytical control prior to the melting operation.

Further, the invention implies that the resulting product will be present in a non-dusting granulated form, preferably as free-flowing spherical granules.

A further advantage of the present process resides in the fact that it is also not necessary to incorporate components such as found in "Comp.D-2" due to said components, if required, having already in a simple and safe manner been incorporated in the granules which constitute the finished Hexotonal.

The process of the present invention, in its principle, is based on the fact that the aluminum powder subject to dusting is bound to RDX, wax being used as a binder, in the form of non-dusting granules. Such granulating process takes place below water, in a per se known way, and requires that the aluminum powder has been pretreated in order to tolerate water.

In the same way, granulates of TNT are prepared, wherein, according to need, wetted NC and lecithin are dissolved. Both granulates can be used separately in the final blasting charge, both components having to be charged proportionally according to the prescribed Hexotonal.

According to a preferred embodiment of the invention both granulates can be combined in one product, either by simple mixing of granules, or by coalescing. The last mentioned process may be carried out in a separate melting kettle, followed by casting in a suitable equipment which will yield a distribution which may be called a "plate granulate".

As an alternative to the casting, the coalescing may be carried out in situ, whereby the not yet solidifed granules are joined by combining the above mentioned granulating processes in one and the same granulating tank.

In the last mentioned case, the product will be present as a homogeneous, free-flowing spherical granulate having the required total composition.

The following table summarizes examples of aluminum-containing high-energy explosives which may be prepared by the present process (in parts by weight).

| Constituents | H-6 | HBX-1 | HBX-3 | Torpex | Hexotonal | HTA-3 | SSM8870 |
|---|---|---|---|---|---|---|---|
| RDX or HMX | 45 | 40 | 31 | 42 | 40 | 49+ | 30,5 ± 2 |
| TNT | 35 | 38 | 29 | 40 | 42 | 29 | 40,9 ± 2 |
| Al | 20 | 17 | 35 | 18 | 15 | 22 | 23,8 ± 2 |
| Wax ($D_2$) | 5 | 5 | 5 | | 3 | | 4,8 |
| $CaCl_2$ | + | + | + | | | | |

+HMX

The following table shows the general composition of a product prepared by the process according to the invention:

| | |
|---|---|
| RDX | 25 to 50% by weight |
| TNT | 25 to 50% by weight |
| Al | 13 to 27% by weight |
| Wax | 2 to 7% by weight |
| NC | 0.5 to 3% by weight |
| Lecithin | 0.1 to 2% by weight. |

In a specific embodiment of the invention a product is prepared which contains the following constituents:

| | |
|---|---|
| TNT | 8 to 20 parts by weight |
| NC | 0.5 to 3 parts by weight |
| Lecithin | 0.1 to 0.5 parts by weight |
| Wax | 0 to 20 parts by weight. |

In the following, examples will be given which show the preparation of some specific types of aluminum-containing explosives for casting.

EXAMPLE 1

To a 10 liters reactor, equipped with devices for controlable stirring, heating and cooling, the following components were charged in the stated order:

| | | |
|---|---|---|
| A. | 9 liters of water | |
| | 1569 g | RDX according to U.S. Spec. Mil.-R-398C, Class D, and German TL 1376-802, Type B. |
| | 169 g | paraffin wax, m.p. 86° C., Type H 129, U.S. Spec. Mil-W-20553 |
| | 11 g | montan wax, Type S, according to German TL 9160-002 Entwurf, the temperature increased to 95° C., stirring 300 r.p.m. |
| | 1224 g | Al-powder according to U.S. Spec. Mil.-A-512A, Grade F, Class 6, Type III, Atomized Dichromated |
| Total | 3000 g | dispersed substances in water in the ratio 1:3. |

The temperature was reduced to 40° C., the granules filtered off and dried at 60° C.

Composition of granulate A: RDX/Al/wax: 52.3/40.8/6.9.

| | | |
|---|---|---|
| B. | (further charging, the same reactor): 6 liters of water | |
| | 2943 g | TNT according to U.S. Spec. Mil.-T-248c and German TL-1376-801. The temperature was increased to 90° C., stirring at 580 r.p.m. |
| | 51 g | NC according to U.S. Spec. Mil.-N-244 Grade D (½ sec.) |
| | 6 g | lecithin, according to U.S. Spec. Mil.-L-3061 |
| Total | 3000 g | dispersed substances in water, in the ratio 1:2. |

The temperature was reduced to 60° C., the granulate filtered off and dried at the same temperature.

Composition of granulate B: TNT/NC/lecithin: 98.1/1.7/0.2.

Both granulates were charged in a melting kettle under stirring, in the ratio 58.3% of A and 41.7% of B. Subsequent to heating to 85° C. and complete coalescing, the mixture was cast on a stainless steel plate in 15 mm thickness.

The solidified product shows great homogeneity, the surface of fracture having no visible faults. The composition is as described for the German SSM-TR-1376-8870, in % by weigh: RDX 30.49, TNT 40.91, Al 23.79, wax 4.02, NC 0.71, lecithin 0.08.

EXAMPLE 2

To a 100 liters reactor equipped as stated above, the following components were charged:

A 70 liters of water 10,450 kg of RDX, 1,330 kg paraffin wax and 70 g montan wax.

After increasing the temperature to 95° C. was added: 8150 kg of aluminum, as above.

Stirring at 250 r.p.m. and cooling to 60° C., filtering and drying 20 kg of granulate A.

B

Further charging in the same reactor:

100 liters of water, 19.62 kg of TNT, 340 g of NC and 40 g of lecithin. Stirring at 400 r.p.m., temperature increased to 85° C., maintained for 10 minutes, cooling to 60°, filtering and drying about 20 kg of granulate B, as above.

Both granulates were blended in dry state on a "Static-Mixer" in the ratio 58.3/41.7, for A and B, respectively, yielding a product with even distribution of visible silver-grey and yellow grains.

The product satisfies the requirements for the Hexotonal type SSM-TR-1376-8870 as above, and may be charged directly into the melting kettle for casting war heads.

EXAMPLE 3

To a 100 liters reactor, as above, the following components were charged under stirring, 250 r.p.m.:

50 liters of water at 60° C.
5.23 kg of RDX
0.64 kg of paraffin wax
0.05 kg of montan wax S.

The temperature was increased to 90° and then was added:

4.08 kg of Al-powder, stabilised as described above.

After 10 minutes were added:

7.06 kg of TNT
0.125 kg of NC
0.015 kg of lecithin.

The batch was cooled to 60° C. and the granulate thus formed filtered off and dried. Yield: 17.2 kg.

The composition was corresponding to SSM-TR-1376-8870 and could be used for melt loading thereof.

EXAMPLE 4

To a 10 liters reactor, having tempering and stirring devices, were added 3 liters of water and heated to 80° C. under stirring at 580–640 r.p.m. In addition, the following components were charged:

823 g of TNT according to German TL-1376-801
29 g of NC (calculated as dry substance), wetted type lacquer ½ sec.
4 g of lecithin according to U.S. Spec. Mil.-L-3061
144 g of petroleum wax, m.p. 86° C., Type H 129, according to U.S. Spec. Mil.-W-20553.

During the addition of wax the temperature was increased to 86° C. and maintained at said temperature for 10 minutes, and then reduced to 40° C. The granulate thus formed, in total 1 kg, was filtered and dried.

This product contains, in addition to TNT, all constituents normally comprised in the flegmatising agent "Comp. D-2" and in the proper mutual proportions.

The granulate, having the following composition by weight: 82.3% of TNT, 14.4% of wax, 2.9% of NC and 0.4% of lecithin, is suitable for charging in a melting kettle together with the usual commercial product "Comp.B" 60/40+1 (RDX/TNT+wax) and Al-powder used traditionally. Thus, the product replaces "Comp.D-2" as well as the additional amount of TNT being required for the traditional manufacture of the above mentioned Hexotonal.

In this case the recipe for the above mentioned SSM-8870 will be:

24.3% by weight of granulate TNT/NC/L/wax
51.9% by weight of "Comp.B"
23.8% by weight of aluminum powder.

The examples brought herein all lead to the same product, viz., SSM-8870. It will be appreciated that the examples are only for illustrating purposes and should not be taken as restricting the use of the claimed process.

The aluminum-containing high-energy explosives of the types mentioned in the introduction, comprised by the term Hexotonal, as well as many other possible grades, among others not commonly known, HMX-based types, here termed "Octonal", contain substantially the same components, however, in most varying proportions.

EXAMPLE 5

As stated in Example 1A, the following components were charged in the stated order:

| | | |
|---|---|---|
| | 5 liters of water | |
| | 515 g | of RDX |
| | 68 g | of wax |
| | 12 g | of NC |
| | 2 g | of lecithin |
| | 403 g | of Al-powder |
| Total | 1000 g | dispersed substances in water, in the ratio 1:5. |

The temperature was reduced to 60° C., the thus formed granulate filtered off and dried at 60° C.

The finished granulate was melted with TNT in the weight ratio 59.1:40.9 and, upon casting gave the required final product having a composition corresponding to SSM-8870.

EXAMPLE 6

To a 10 liters reactor the following components were charged:

| | |
|---|---|
| RDX | 320 g (dry) |
| TNT | 430 g |
| Al, passivated | 250 g |
| Total | 1000 g |

Under stirring at 300 r.p.m. 3 liters of water were charged, as well as RDX and Al, and the mixture was heated to 85° C. Subsequently, TNT was added and the temperature maintained for one half minute, whereafter the mixture was cooled and 4 liters of cold water added. The granulate was filtered off and dried.

The product was satisfactory and was used for casting together with 48 g of the flegmatising agent Comp.D-2, having the following composition:

30.5 RDX, 41.0 TNT, 23.8 Al, 4.6 D-2, % by weight.

EXAMPLE 7

To a 10 liters reactor the following components were charged:

| | | Composition, % |
|---|---|---|
| RDX | 499 g (dry) | 49.9 |
| NC | 11 g (dry) | 1.1 |
| Lecithin | 2 g (dry) | 0.2 |
| Wax blend | 65 g | 6.5 |
| Al | 389 g | 39.0 |
| TNT | 33 g | 3.3 |
| | 999 g | 100.0 |

The blending was carried out in a 10 liters reactor as described above, by first charging 3 liters of water+RDX+NC+lecithin+TNT. The mixture as heated to 65° C., wax added and heated further to 95° C. under stirring, 250 r.p.m., then aluminum was added and the temperature maintained at 95° C. for 10 minutes. After cooling and filtering, the granulate was dried.

The product was employed for casting mines with TNT in the ratio 61.1:38.9, with excellent result.

EXAMPLE 8

In a reactor as described above, the following were charged:

| | |
|---|---|
| RDX | 516 g |
| Wax blend | 68 g |
| NC | 12 g |
| Lecithin | 2 g |
| Al | 403 g |
| Total | 1001 g |

First, 3 liters of water+RDX+NC+lecithin were blended, heating was performed to 65° C. under stirring, wax was added and the whole mixture heated to 95° C. After addition of aluminum, the temperature was maintained at 95° C. for 10 minutes, cooled, filtered and dried.

The granulate was mixed with TNT in the ratio 59.1:40.9 and proved a homogeneous product of correct composition and appearance.

I claim:

1. A process for the preparation of a castable, high-energy explosive composition comprising trinitrotoluene (TNT), RDX or HMX crystalline explosive and aluminum powder, comprising the following steps:

A. dispersing wax and crystals of RDX or HMX in water with heavy stirring at a temperature above the melting point of the wax, then adding aluminum powder, treated in order to tolerate water, to the dispersion, thereby forming a dispersed mixture, cooling the mixture and separating it in the form of granules; and B. combining TNT with said dispersed mixture or with said granules, thereby obtaining said castable composition.

2. A process according to claim 1, wherein the TNT of step B is separately melted and dispersed in hot water with heavy stirring, the temperature is reduced to below 80° C., granules of TNT are separated and are combined with the granules obtained from the dispersed mixture of step A.

3. A process according to claim 2, wherein the combined granules are melted together and the melt is cast on a drum, ribbon or plate, thereby producing a plate granulate.

4. A process according to claim 1, wherein the TNT of step B is combined with the dispersed mixture of step A forming a combined mixture which is cooled and separated in the form of granules of said castable composition.

5. A process according to claim 1, wherein lecithin and nitrocellulose are added to the dispersion of step A.

6. A process according to claim 2, wherein lecithin and nitrocellulose are added to the separate dispersion of TNT.

7. A process according to claim 6, wherein additionally wax is added to the separate dispersion of TNT.

8. A process according to claim 1, wherein the wax in step A is pure montan wax.

9. A process according to claim 1, wherein the wax is petroleum wax admixed with refined montan wax.

10. A process according to claim 9, wherein the refined montan wax amounts to 1 to 12%, calculated on the total wax amount.

11. A process according to claim 8 or 9, wherein the montan wax is KP wax or S wax, separately or in admixture.

12. A process according to claim 1, wherein the obtained castable composition is composed of the following, by weight:

| | |
|---|---|
| RDX or HMX | 25 to 50% |
| TNT | 25 to 50% |
| Al | 13 to 37% |
| Wax | up to 7%. |

13. A process according to claim 5 wherein the obtained castable composition is composed of the following, by weight:

| | |
|---|---|
| RDX or HMX | 25 to 50% |
| TNT | 25 to 50% |
| Al | 13 to 37% |
| Wax | up to 7% |
| Nitrocellulose | up to 3% |
| Lecithin | up to 2%. |

14. A process according to claim 6 wherein the obtained TNT granules are composed of the following, by weight:

| | |
|---|---|
| TNT | 8 to 30 parts |
| Nitrocellulose | 0.5 to 3 parts |
| Lecithin | 0.1 to 0.5 parts. |

15. A process according to claim 7, wherein the obtained TNT granules are composed of the following by weight:

| | |
|---|---|
| TNT | 8 to 20 parts |
| Nitrocellulose | 0.5 to 3 parts |
| Lecithin | 0.1 to 0.5 parts |
| Wax | up to 20 parts. |

* * * * *